US008151990B2

(12) United States Patent
Udo et al.

(10) Patent No.: US 8,151,990 B2
(45) Date of Patent: Apr. 10, 2012

(54) BLISTER PACKAGE ARRANGEMENT

(76) Inventors: Simon Udo, Nuremberg (DE); Ernst-Rudolf Radtke, Pegnitz (DE)

( * ) Notice: Subject to any disclaimer, the term of this patent is extended or adjusted under 35 U.S.C. 154(b) by 186 days.

(21) Appl. No.: 10/582,736

(22) PCT Filed: Dec. 14, 2004

(86) PCT No.: PCT/DE2004/002740

§ 371 (c)(1),
(2), (4) Date: Jun. 13, 2006

(87) PCT Pub. No.: WO2005/058723

PCT Pub. Date: Jun. 30, 2005

(65) Prior Publication Data

US 2007/0084746 A1 Apr. 19, 2007

(30) Foreign Application Priority Data

Dec. 19, 2003 (DE) ..... 103 60 689

(51) Int. Cl.
*B65D 83/04* (2006.01)

(52) U.S. Cl. ..... 206/534; 206/531; 221/7

(58) Field of Classification Search ..... 206/531, 206/828, 832, 528, 229, 532, 534; 428/76; 221/4, 5, 6, 22, 25, 7; 368/10
See application file for complete search history.

(56) References Cited

U.S. PATENT DOCUMENTS

| | | | | |
|---|---|---|---|---|
| 4,526,474 | A | 7/1985 | Simon | |
| 4,617,557 | A * | 10/1986 | Gordon | 340/309.7 |
| 4,660,991 | A * | 4/1987 | Simon | 368/10 |
| 5,072,430 | A * | 12/1991 | Eckernas et al. | 368/10 |
| 5,181,189 | A * | 1/1993 | Hafner | 368/10 |
| 5,348,158 | A * | 9/1994 | Honan et al. | 206/531 |
| 5,412,372 | A * | 5/1995 | Parkhurst et al. | 340/568.1 |
| 5,549,204 | A * | 8/1996 | Toren | 206/539 |
| 5,597,072 | A * | 1/1997 | Lieberman et al. | 206/534 |
| 5,613,609 | A * | 3/1997 | Hamilton et al. | 206/531 |
| 5,871,831 | A * | 2/1999 | Zeiter et al. | 428/76 |
| 6,244,462 | B1 * | 6/2001 | Ehrensvard et al. | 221/7 |
| 6,976,576 | B2 * | 12/2005 | Intini | 206/1.5 |
| 7,126,879 | B2 * | 10/2006 | Snyder | 368/10 |
| 2003/0111477 | A1 * | 6/2003 | Niemiec et al. | 221/2 |
| 2004/0178112 | A1 * | 9/2004 | Snyder | 206/534 |

FOREIGN PATENT DOCUMENTS

| | | | |
|---|---|---|---|
| CA | 2 472 162 | A1 | 12/2002 |
| DE | 3818705 | A1 | 6/1988 |
| EP | 0 180 073 | A2 | 10/1985 |
| WO | WO 03/068137 | A1 | 8/2003 |

* cited by examiner

*Primary Examiner* — Jacob K Ackun
*Assistant Examiner* — Jenine Pagan
(74) *Attorney, Agent, or Firm* — Renner, Otto, Boisselle & Sklar, LLP

(57) ABSTRACT

A blister package arrangement comprises a blister package (1) and a conductor carrier strip (10) attached thereto, wherein openings (4) of the carrier strip (10) are oriented toward pockets (3) of the blister package (1). When a tablet (2) is removed from a pocket (3), the sealing film (13) of the blister package (1) closing the pocket (3) is separated in such a way that the tablet (2) is removable through the opening (4) associated therewith. The openings (4) are formed by stamped cutting lines (41) which are disposed in the conductor carrier strip (10) and surround the pockets (3) of the associated areas in a ring shape. These stamped lines are interrupted by at least two spars or "bridge parts" (43) by means of which a cover (30), covering the pocket (3) and separated from the conductor carrier strip (10), is connected with the carrier strip.

20 Claims, 6 Drawing Sheets

FIG. 14
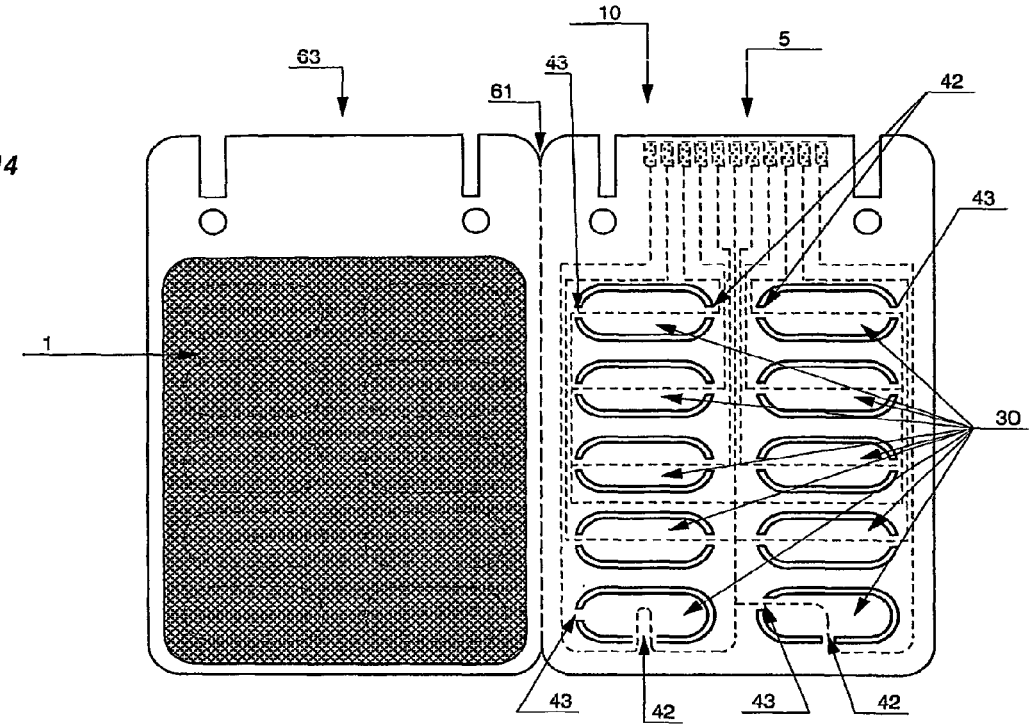
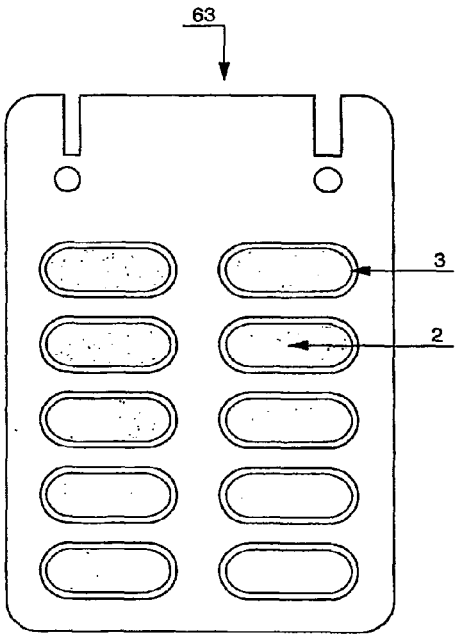
FIG. 15
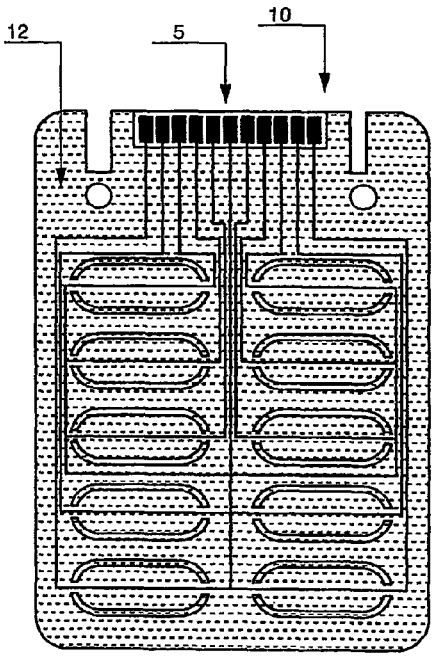
FIG. 16

BLISTER PACKAGE ARRANGEMENT

BACKGROUND OF THE INVENTION

The invention relates to a blister package arrangement which comprises a blister package and a conductor carrier strip attached thereto, wherein openings of the carrier strip are oriented toward pockets of the blister package. When a tablet is to be removed from a pocket the sealing film of the blister package closing the pocket is separated, allowing the tablet to be removed.

Blister packages of this type containing pharmaceutical tablets provided in pockets are well known. For this, electrical conductors usually extend across the surface of a sealing film sealing the pockets over the area of the pockets so that they are broken when a tablet is removed from the pocket of the blister package. A blister package arrangement of this type includes a receiver device for the blister package having an electronic unit that senses the break in the circuit and stores this detection of the removal of the medication. Such a blister package arrangement is known, for example, from EP 0 180 073 A1.

SUMMARY OF THE INVENTION

It is the principal object of the invention to configure a blister package arrangement for a blister package whose sealing film does not include individual conductors such that simple removal of a tablet from a pocket of the blister package and a simultaneous separation of the individual conductor of a conductor carrier strip assigned to each pocket is ensured.

This object, as well as further objects which will become apparent from the discussion that follows, are achieved, in accordance with the present invention, by stamping cutting lines in the conductor carrier strip which surround the pockets in a ring shape. These stamped lines are interrupted by at least two spars, by means of which a cover over the pocket is connected with the carrier strip. The spars are distributed around the periphery of the stamped lines in such a way that one spar is severed when the associated tablet is pressed out from the pocket. The conductor carrier strip comprises, on the part thereof opposite to the blister package, individual conductors, each of which extends from an individual connecting contact pad over at least one spar and is severed upon removal of the associated tablet.

The essential advantage of the invention is the fact that those areas of the conductor carrier strip assigned to one of the blister packages that cover the pockets of a blister package, and over which the individual conductors extend, are each separated from the conductor carrier strip by a ring-shaped stamped line surrounding the pocket. This ensures that the tablets may be easily removed with precise definition.

Since at least two spars or "bridge parts" are provided, by means of which the area separated from the conductor carrier strip by means of the stamped line (hereafter referred to as the covering) is connected to the conductor carrier strip, an advantageous completely targeted and defined removal of the covering upon removal of the tablet from the pocket assigned to the covering and positive separation of the assigned individual conductor may be ensured. The conductor routing over the covering may advantageously be accomplished individually, in dependence upon the desired removal parameters, by means of the at least two spars (bridge parts), or by means of only one of the two spars, whereby it is ensured that the individual conductor is broken when its tablet is removed.

For a full understanding of the present invention, reference should now be made to the following detailed description of the preferred embodiments of the invention as illustrated in the accompanying drawings.

BRIEF DESCRIPTION OF THE DRAWINGS

FIGS. 12~16 show a conductor carrier strip configured as a book-type carrier device.

DESCRIPTION OF THE PREFERRED EMBODIMENTS

Figure 1:
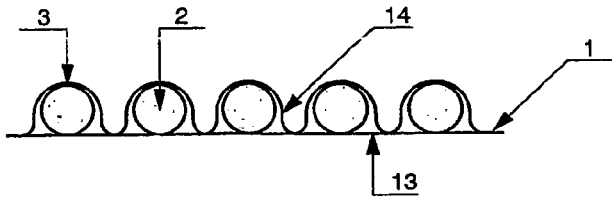
FIG. 1 is a schematic view of a known blister package.

The preferred embodiments of the present invention will now be described with reference to FIGS. 1-17 of the drawings. Identical elements in the various figures are designated with the same reference numerals.

The following considerations led to the invention: In a known, conventional blister package that does not include individual conductors extending through the areas of the sealing film over the pockets, when a conductor carrier strip with coverings for the above-mentioned areas of the sealing film is to be provided, whereby the individual conductors extend over the coverings, it must be ensured that, during conventional removal of a tablet from a pocket by opening the area of the sealing film of the blister package, the covering positioned over the area of the conductor carrier strip is separated from the conductor carrier strip simultaneously, and also cleanly and simply. Only then is simple, clean tablet removal ensured. In this connection, the thought first arose to separate the covering from the remaining area of the conductor carrier strip by means of a stamped line, that the covering may be simply separated from the conductor carrier strip by pressure from the pocket side onto the tablet, and from the tablet onto the sealing film and the covering. If one provides such a covering separated from the conductor carrier strip by a stamped line, it must be ensured that: (1) conductor routing from the conductor carrier strip is possible via the covering, and (2) when separating the covering upon removal of a tablet it is ensured that the individual conductor is broken. For this purpose, it is proposed by the invention to connect the covering with the conductor carrier strip by means of at least two spars or "bridge parts," whereby theses spars interrupt the stamped line. For this, a minimum of two spars are to be positioned along the extent of the ring-shaped stamped line so that, upon tablet removal, at least one of the spars is broken in any case. Upon separation of precisely this spar, the individual conductor assigned to this pocket must also be broken and electrically interrupted.

Figure 2:
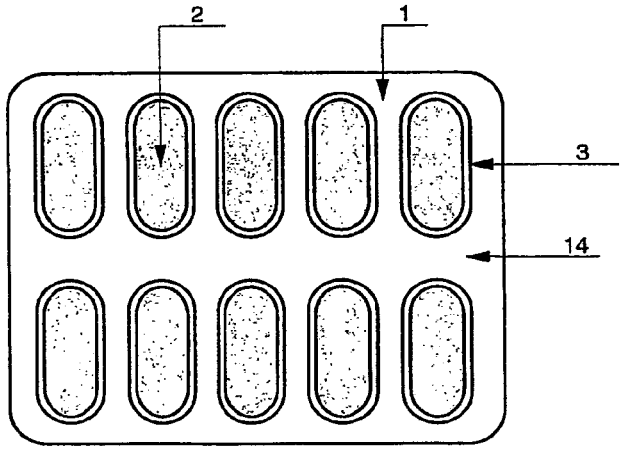
FIG. 2 is a view of the blister package of FIG. 1 from the direction of the deep-drawing film.

FIGS. 1 and 2 show a known blister package 1, whereby FIG. 2 shows a top view of the blister package 1 on the side of the deep-drawing film 14 and FIG. 1 shows a side view of the blister package 1. The individual bins or pockets to contain the medication or tablets 2 are designated with the reference numeral 3.

Figure 1A:
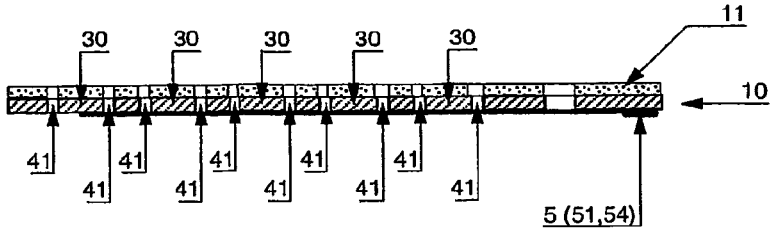
FIG. 1*a* shows a cross-section through a conductor carrier strip that, with the help of an adhesive layer, is to be adhered to the blister package of the type shown in FIG. 1 to produce the blister package.
Figure 7:
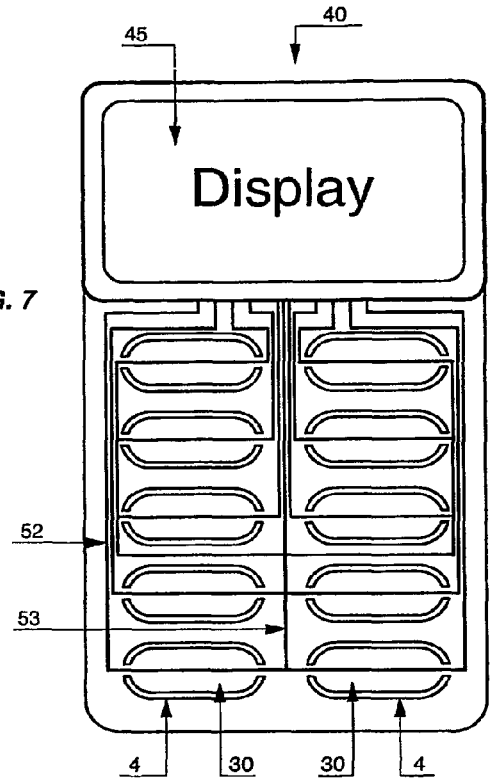
FIG. 7 shows a blister package arrangement inserted into a receiver device surrounding the electronic components.

Per FIG. 1*a*, a conductor carrier strip 10 to be connected to the blister package 1 includes an adhesive layer 11 on the side facing toward the blister package 1 which adheres the conductor carrier strip 10 to the blister package 1 and possesses connection points 51, 54 of an interface 5 on the side facing away from the blister package 1. Such connection points become electrically connected when the conductor carrier strip 10 is inserted into a receiver device 40 with an electronic unit (not shown) positioned within the receiver device 40. Such a receiver device 40 is shown in FIG. 7. In a known manner, an individual conductor 52 extends from each individual connection point 51 along the surface of the conductor carrier strip 10 over a pocket 3 containing a tablet 2 when the blister package is mounted to a common conductor 53 which, in turn, is connected via a common connection point 54 to the interface 5. A display to show the data pertaining to the tablet removal is designated with the reference numeral 45 (FIG. 7).

Figure 3:
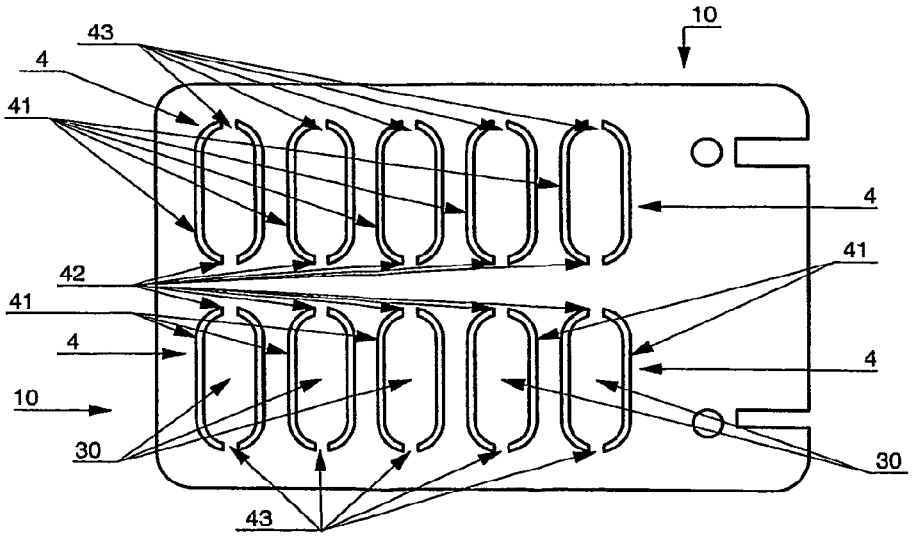
FIG. 3 is a view of the side of the conductor carrier strip facing the blister package arrangement of FIGS. 1 and 2.
Figure 4:
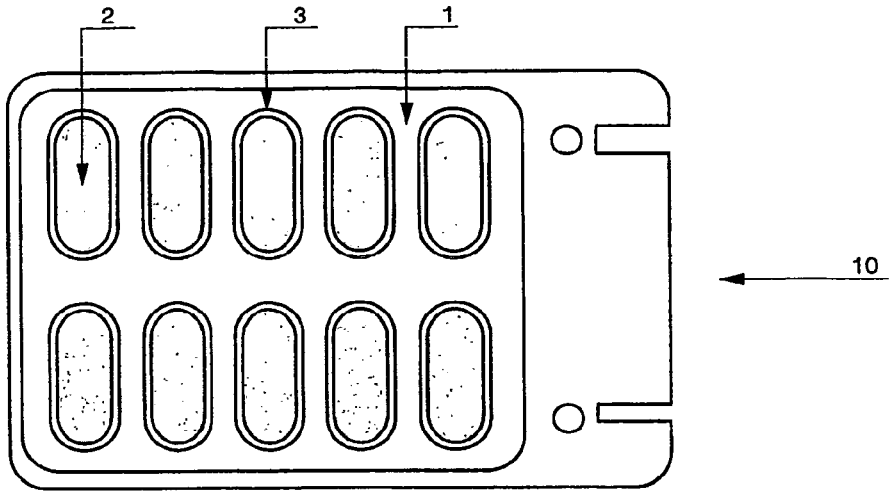
FIG. 4 is a view of the conductor carrier strip as in FIG. 3, whereby a blister package as in FIG. 2 is connected with the conductor carrier strip.

An opening 4 of the conductor carrier strip 10 is assigned to each pocket 3 of the blister package 1, whereby the exertion of pressure against the pocket 3 containing the tablet 2 required to remove the tablet separates the sealing film 13 and forces the tablet through the opening 4 of the conductor carrier strip 10. FIG. 3 shows the conductor carrier strip 10 seen from the side facing the blister package 1, whereby the blister package 1 is not yet mounted or secured on the conductor carrier strip 10. FIG. 4 shows a corresponding view of the conductor carrier strip 10, whereby the blister package 1 is already connected with the conductor carrier strip 10.

According to the invention, the opening 4 for tablet removal is formed by a ring-shaped, closed stamped line 41, positioned in the conductor carrier strip 10, which separates the surrounding area from the portion of conductor carrier strip 10 that covers the area of an assigned pocket 3 of the blister package 1. Therefore, when pressure is exerted against the conductor carrier strip 10 during tablet removal, the corresponding covering 30 is pressed out of the conductor carrier strip 10 because of the stamped line 41 that forms the opening 4.

Figure 5:
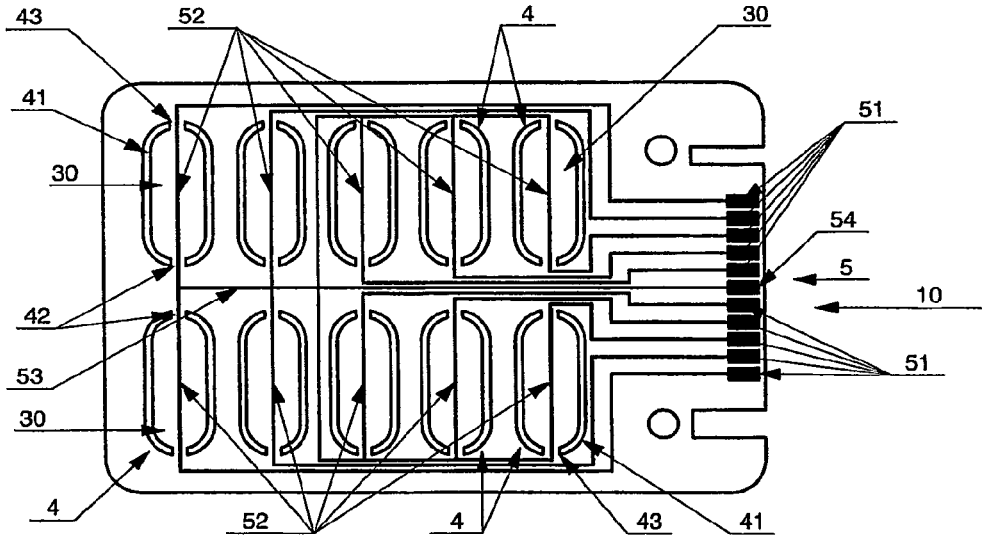
FIG. 5 is a view of the side of the conductor carrier strip facing away from the blister package.

FIG. 5 shows a view of the conductor carrier strip 10 from the side facing away from the blister package 1 connected therewith.

Figure 6:
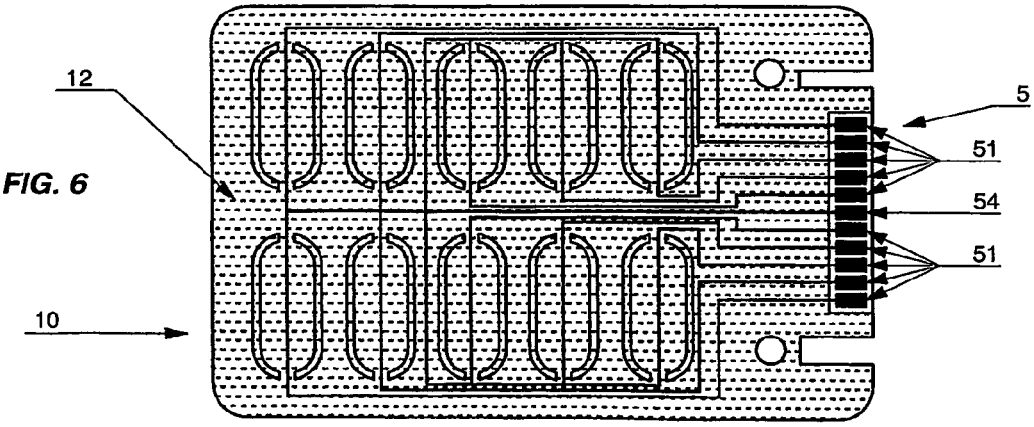
FIG. 6 shows a conductor carrier strip as in FIG. 5 with a protective layer covering the conductors.

FIG. 6 shows a protective layer 12 that may be mounted on the surface of the conductor carrier strip 10 facing away from the blister package 1 covering at least the outer surface of the individual conductors 52 and the common conductor 53 to protect them. The connection points 51, 54 of the interface 5 are recessed in order to allow positive contact with the receiver device 40.

According to the invention, the coverings 30 are each connected by means of at least two spars or "bridge parts" 42, 43 to the conductor carrier strip 10, whereby each spar 42, 43 represents an interruption of the stamped line 41, as is particularly visible in FIG. 3. As used throughout, the spars 42, 43 are to be interpreted as equivalent to bridge parts, as the term "bridge part" is believed to be a more common description of elements 42, 43 shown in FIG. 3.

The spars 42, 43 are so distributed about the circumference of the stamped line 41 in such a manner that tablet removal is only possible if at least one spar 42 or 43 is broken, and the covering 30 is pressed up out of the plane of the conductor carrier strip 10, whereby the spar 43 or 42 that is not broken may serve as a piano hinge when the covering 30 is pivoted.

Figure 9:
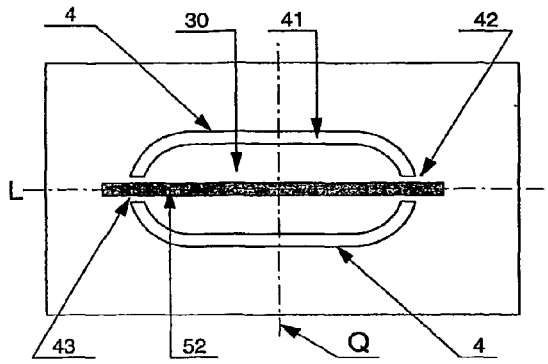
FIG. 9 is an embodiment in which the stamped line separating the covering includes spars on the two opposing sides extending longitudinally along the covering, whereby the individual conductor extends over both spar pieces.
Figure 10:
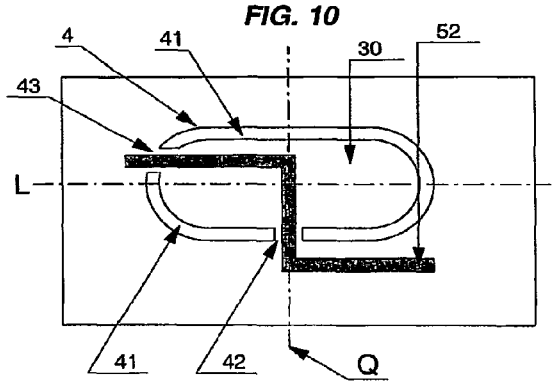
FIG. 10 is an embodiment in which the spar is positioned on one end of the covering as seen along the longitudinal direction of the covering and an additional spar is positioned approximately in the center of an area extending longitudinally along the stamped line, whereby the individual conductor extends over both spars.
Figure 11:
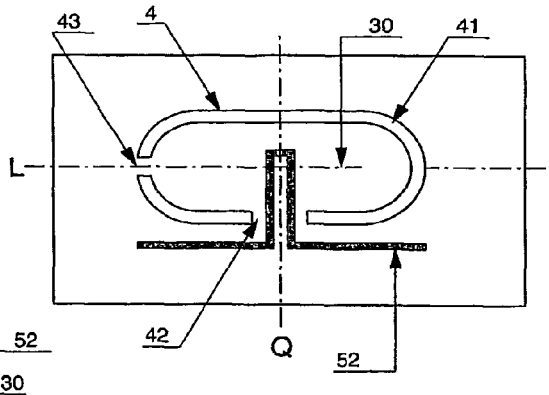
FIG. 11 shows another embodiment in which the spars are positioned similarly to those in FIG. 10, but the individual conductor extends as a loop over the one or the other spar.

FIGS. 9 through 11 show various preferred and particularly advantageous configurations of the spars 42, 43 along the stamped line 41. Per FIG. 9, the spars 42, 43 are arranged along the direction of the longer extension (longitudinal direction) opposite the covering 30 along the stamped line 41 so that tablet removal causes at least one of these spars, or both spars, to be broken. In this case, the individual conductor 52 extends longitudinally along the covering 30 and over the spars 42 and 43. The individual conductor 52 preferably extends along the longitudinal centerline L of the covering 30.

Per FIG. 10, one spar is on the end of the covering 30 as seen along the longitudinal direction of covering 30, and an additional spar 42 is positioned approximately in the center of an area of the stamped line 41 extending longitudinally, whereby the individual conductor 52 extends over both spars 42, 43. For this, the first spar 43 is positioned preferably outside the longitudinal centerline L of the covering 30. The other spar 42 is preferably located on the side of the longitudinal centerline L facing away from the other spar 43, specifically outside the cross centerline Q of the covering 30. The individual conductor 52 may extend over the covering 30 in any manner.

Per FIG. 11, the first spar 43 is again on one end of the stamped line 41 as seen along the longitudinal centerline L. The other spar 42 is relatively wide, and is located approximately along the axis of the cross centerline Q. The individual conductor 52 extends over the spar 42 onto the covering 30 as seen from the conductor carrier strip 10, forms a loop there, and then extends back from the covering 30 via the spar 42 to the conductor carrier strip 10. Upon tablet removal, the covering 30 is so opened that in any case the spar 42 and the conductor 52 extending over it are broken.

Figure 8:
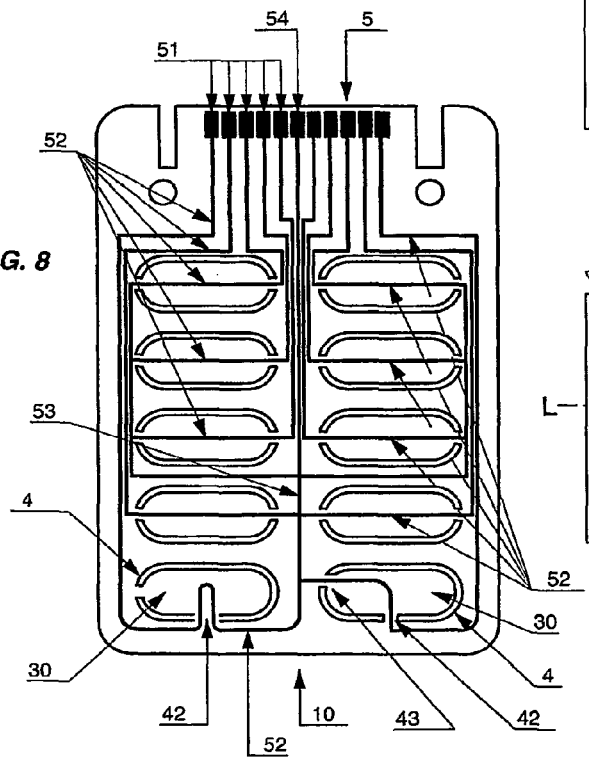
FIG. 8 is a view of the side of the conductor carrier strip facing away from the blister package, whereby three different types of spar configurations and conductor routings are shown for the sake of explanation.

FIG. 8 shows an example of all three embodiments in FIGS. 9 through 11 in a sample conductor including the individual conductor 52, the common conductor 53, and the connection points 51, 54 of the interface 5.

FIGS. 12 through 16 show a book-shaped carrier strip 60 in which the conductor carrier strip 10 may be folded toward a second part 63 along a fold line 61 as a first part equivalent to the covering, said first part being connected to the conductor carrier strip 10. In the second part 63, insertion openings 62 are positioned that are directed toward the stamped line 41 when the parts 10 and 63 are folded together like a book along the fold line 61. To produce this blister package configuration 10, a blister package 1 is so positioned on the second part 63 that its pockets 3 engage with the insertion openings 62 of the part 63, whereby simultaneously the blister package 1 is directed in the necessary manner toward part 63, and also toward the conductor carrier strip 10. Subsequently, parts 10 and 63 are folded together like a book along the fold line 61 and connected together, preferably by an adhesive. The blister package 1 is thus located in exactly the correct position between parts 10 and 63. The parts 10 and 63 are thereby of such dimensions that they project over the blister package 1 on all sides, whereby the projecting edge areas of parts 10 and 63 are firmly adhered to each other so that separation and removal of the blister package 1 is not possible.

A comment here can be made that instead of several individual insertion openings 62, a single insertion opening 62' may be provided that can receive all pockets of the blister package 1 simultaneously.

Figure 12:
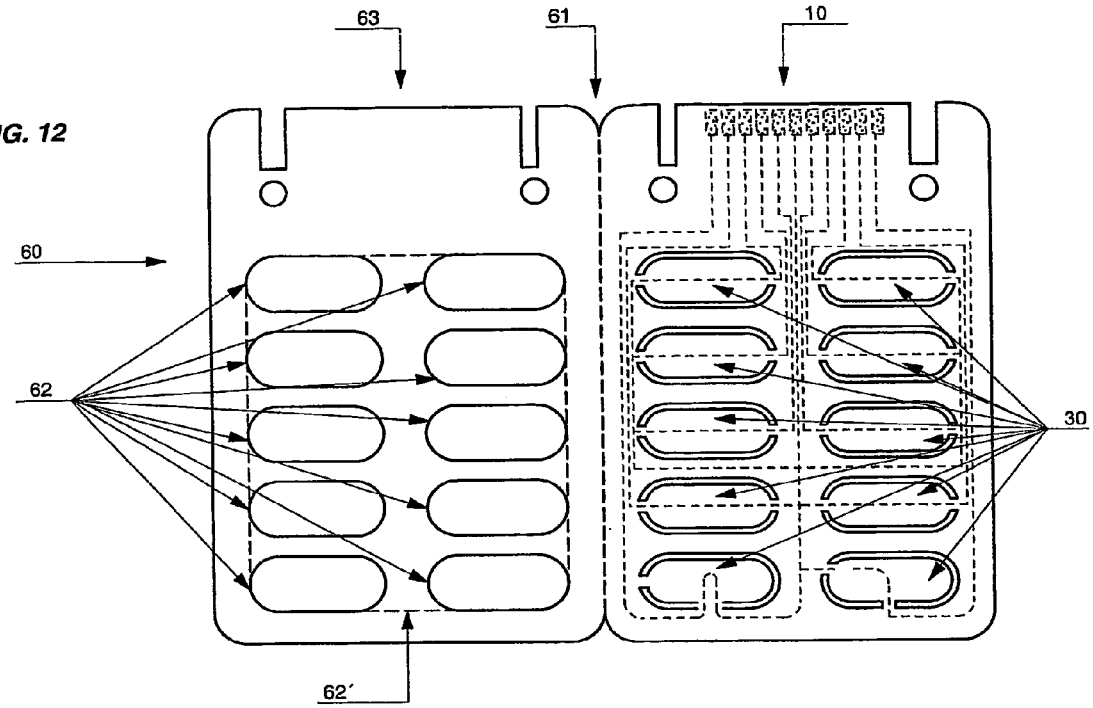
Figure 13:
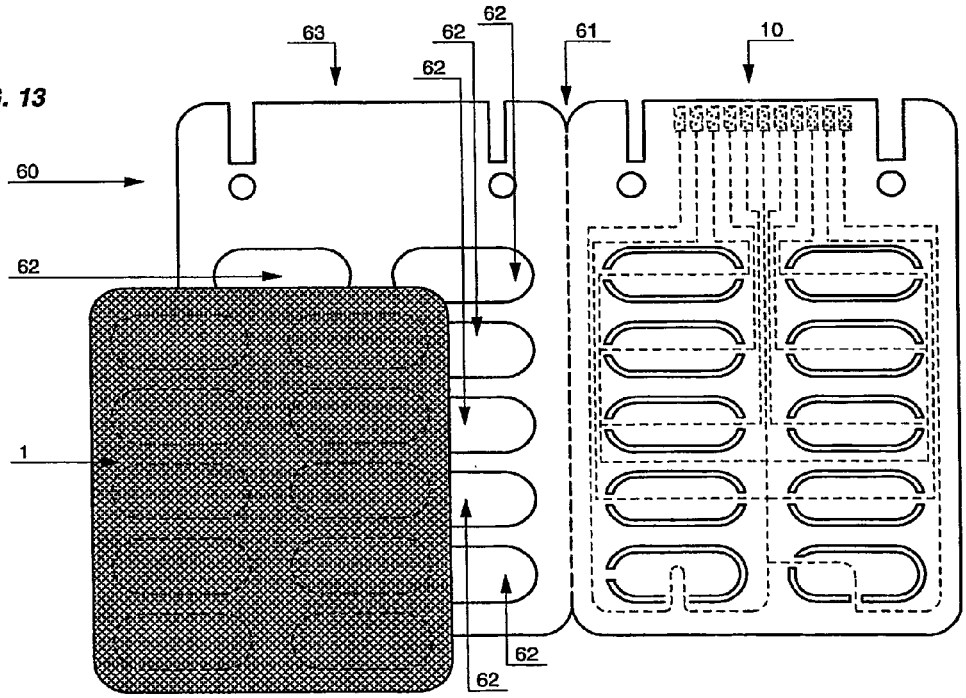

FIGS. 12 through 14 show views of the carrier strip 60 from within, whereby per FIG. 13 the blister package 1 is inserted straight, and per FIG. 14, it has already been inserted. FIG. 15 shows the part 63 with the inserted blister package 1 from without, and FIG. 16 shows a view of the carrier strip 10 from without.

In the following, an additional preferred embodiment of the invention will be described with reference to FIGS. 17*a* through 17*c*. Details from FIGS. 17*a* through 17*c* that have already been explained using the previous Figures are designated in a corresponding manner, whereby an apostrophe (') is appended to the pertinent reference numerals.

Figure 17A:
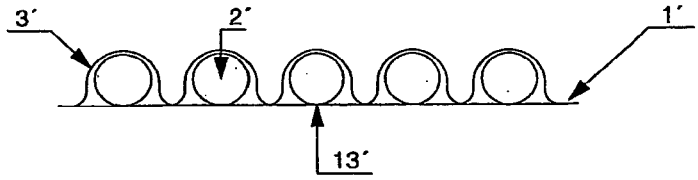
FIG. 17*a*~17*e* illustrate an expanded embodiment of the invention.
Figure 17B:
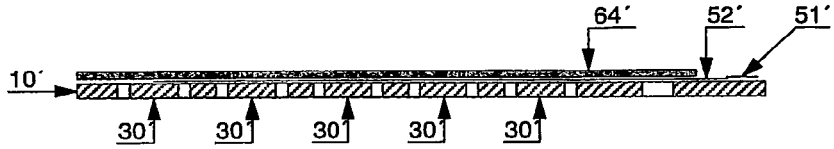
Figure 17C:
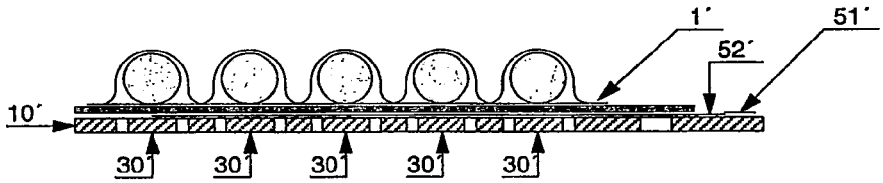

FIG. 17*b* shows a conductor carrier strip 10' that includes the individual connection points 51', the individual conductors 52', the common conductor 53', and the common connection point on the side facing toward the blister package 1' (FIG. 17*a*). An electrically insulating dielectric layer 64' is positioned on the side of the conductor carrier strip 10' facing toward the blister package 1' that covers the individual conductors 52' and the common conductor 53' at least in the area in which, per FIG. 17*c*, the blister package 1' is preferably mounted by adhesion of the sealing film 13' to the dielectric layer 64'.

Figure 17D:
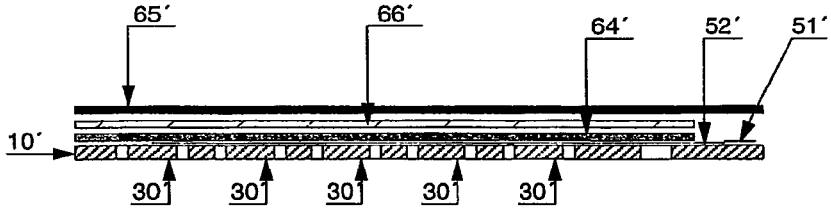
Figure 17E:
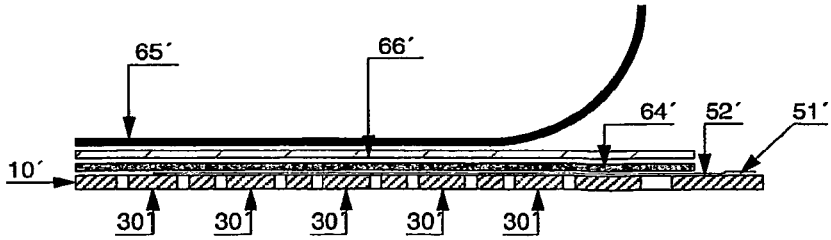

FIGS. 17*d* and 17*e* show a modification of the conductor carrier strip 10' in which an adhesive layer 66' is mounted on the dielectric layer 64' that is covered by a tear film 65'. The tear film 65' preferably extends per FIG. 17*d* along a side over the adhesive layer 66' so that an area is formed that may be manually gripped in order to remove the tear film 65' from the adhesive layer 66'. After removal of the tear film 66', the exposed adhesive layer 66' may be connected with the blister package 1 by pressing against the sealing film 13' of the blister package 1'.

It is also conceivable to form the electrically insulating layer 64' simultaneously as a adhesive layer so that it may be directly adhered to the sealing film 13'.

It should be noted that the preferred embodiments of the carrier strips 10' shown in FIGS. 17*b* through 17*e* may be a component of the book-type carrier strip described in connection with FIGS. 12 through 16.

There has thus been shown and described a novel blister package arrangement which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

The invention claimed is:

1. A blister package arrangement comprising:

a blister package including pockets for containing a tablet and a sealing film for sealing the pockets; and a conductor carrier connected to the blister package, the conductor carrier having openings directed toward the pockets of the blister package, and wherein, upon removal of a tablet from a pocket, the sealing film of the blister package sealing the pocket must be separated, and the tablet is removable through a respective said opening;

wherein the openings are formed by stamped lines positioned within the conductor carrier that surround each of the pockets in a ring shape, and that are interrupted by at least two bridge parts by means of which a covering, separated by the stamped line out of the conductor carrier and covering the pocket, is connected with the conductor carrier;

wherein the bridge parts are so distributed at peripheral locations spaced apart about the periphery of the stamped line that, when a tablet is pressed out from a pocket, at least one of the bridge parts is broken;

wherein the conductor carrier includes plural circuits respectively associated with the openings, each circuit including an individual conductor that extends from an individual connecting pad and has bridge spanning portions extending over the bridge parts at said peripheral locations such that the bridge spanning portions of the individual conductor will be severed upon severing of the bridge parts at the respective peripheral locations; and wherein severing of any one of the bridge spanning portions will break the respective circuit even when the bridge spanning portions at the other peripheral locations remain unbroken.

2. The blister package arrangement according to claim 1, wherein each individual conductor, at its end opposite its associated individual connection pad, is connected with a common conductor which is connected to a common connection pad.

3. The blister package arrangement according to claim 2, wherein the individual connecting pads and the common connection pad are components of an interface and disposed at a defined position orientation for electrical connection with an electronic unit of a receiver device to detect the severance of the individual conductors when the blister package arrangement has been inserted in the receiver device.

4. The blister package arrangement according to claim 1, wherein the stamped lines have a shape selected from the group consisting of rectangular, circular, and oval.

5. The blister package arrangement according to claim 1, wherein the bridge parts include two bridge parts positioned diametrically opposite each other about the circumference of the stamped line, and wherein the individual conductor associated therewith extends over said two bridge parts.

6. The blister package arrangement according to claim 5, wherein the two bridge parts each lie along the direction of a longer extension of the stamped line.

7. A blister package arrangement with a blister package and a conductor carrier connected to it, wherein openings in the conductor carrier are directed toward pockets of the blister package, and wherein, upon removal of a tablet from a pocket, a sealing film of the blister package sealing the pocket must be separated, and the tablet is removable through an opening assigned to it, the improvement wherein the openings are formed by stamped lines positioned within the conductor carrier that surround each of the pockets in a ring shape, and that are interrupted by at least two bridge parts by means of which a covering, separated by the stamped line out of the conductor carrier and covering the pocket, is connected with the conductor carrier; wherein the bridge parts are so distributed about the periphery of the stamped line that, when a tablet is pressed out from a pocket, at least one bridge part is broken; and wherein the conductor carrier includes individual conductors each of which extends from an individual connecting pad over at least the one bridge part that is severed upon tablet removal; wherein the individual conductor extends only over one of the bridge parts from the conductor carrier to the covering, and from the covering back to the conductor carrier as a loop, whereby the conductor-bearing bridge part is positively severed upon tablet removal.

8. The blister package arrangement according to claim 1, wherein the conductor carrier includes the individual conductors on the side facing away from the blister package, and is attached to the side facing toward the blister package by means of the sealing film of the blister package.

9. The blister package arrangement according to claim 8, wherein the conductor carrier is at least partially provided with an electrically insulating protective on its side facing away from the blister package that covers at least the individual conductors and a common conductor.

10. The blister package arrangement according to claim 1, wherein the conductor carrier includes the individual conductors on its side facing toward the blister package, and that the side of the conductor carrier facing toward the blister package is provided with an electrically insulating layer covering the individual conductors, and wherein the side of the electrically insulating layer facing toward the blister package is connected with the sealing film of the blister package.

11. The blister package arrangement according to claim 10, wherein the electrically insulating layer is provided with an adhesive layer that may be connected with the sealing film of the blister package.

12. The blister package arrangement according to claim 11, wherein the adhesive layer is covered by a tear film that may be separated from the adhesive layer in order to connect the adhesive layer to the sealing film.

13. The blister package arrangement according to claim 2, wherein the conductor carrier projects over the blister package at least on the side of the interface.

14. The blister package arrangement according to claim 1, wherein the conductor carrier forms a first component of a member that folds like a book, and a second component of the member forms at least one of an insertion opening for each pocket of the blister package and a common insertion opening for all pockets of the blister package, and may be folded about a fold line with respect to the conductor carrier so that the blister package is accepted between the conductor carrier and the second part, whereby each pocket of the blister package extends through an insertion opening of the second component or all pockets of the blister package through the common insertion opening of the second component, and wherein the conductor carrier, the blister package, and the second component receiving the pockets of the blister package are connected with each other.

15. The blister package arrangement according to claim 14, wherein the conductor carrier and the second component project over the blister package at least on the side of an interface of the conductor carrier with a receiver device.

16. The blister package arrangement according to claim 14, wherein the conductor carrier and the second component project over the blister package on all sides.

17. The blister package arrangement according to claim 14, wherein the fold line extends along the longer side of the conductor carrier and the second component.

18. The blister package arrangement according to claim 14, wherein the conductor carrier, the blister package and the second component receiving the pockets of the blister package are adhered together.

19. The blister package arrangement according to claim 10, wherein the electrically insulating layer is simultaneously an adhesive layer that may be connected to the sealing film of the blister package.

20. A blister package arrangement comprising: a blister package having a plurality of pockets each configured to receive a tablet therein; and a conductor carrier connected to the blister package, the conductor carrier comprising:

a cover area positioned adjacent to each pocket in the blister package, each cover area defined by a stamped line opening formed thereabout in the conductor carrier; at least two bridge parts interrupting each stamped line opening to connect each cover area to a surrounding conductor carrier area, the at least two bridge parts positioned such that at least one bridge part is broken when a tablet is pressed out from the corresponding pocket;

an interface to provide an electrical connection between the conductor carrier and an attachable electronic unit configured to detect removal of a tablet from a pocket of the blister package, the interface comprising a plurality of individual connection pads and a common connection pad arranged in a planar array and exposed for removable connection to a corresponding interface of the electronic unit;

a common conductor extending out from the common connection pad; and an individual conductor extending out from each of the plurality of individual connection pads, over the at least one bridge part of a respective cover area, and connecting to the common conductor, the individual conductor configured to break along with the at least one bridge part that is broken when a tablet is pressed out from the corresponding pocket.

* * * * *